US009896753B2

(12) United States Patent
Fu et al.

(10) Patent No.: US 9,896,753 B2
(45) Date of Patent: Feb. 20, 2018

(54) BULK AMORPHOUS ALLOY ZR—CU—NI—AL—AG—Y AND METHODS OF PREPARING AND USING THE SAME

(71) Applicants: Institute of Metal Research, Chinese Academy of Sciences, Shenyang (CN); DongGuan Eontec Co., Ltd., Dongguan (CN)

(72) Inventors: Huameng Fu, Shenyang (CN); Haifeng Zhang, Shenyang (CN); Zhengkun Li, Shenyang (CN); Aimin Wang, Shenyang (CN); Zhengwang Zhu, Shenyang (CN); Hongwei Zhang, Shenyang (CN); Hong Li, Shenyang (CN); Yangde Li, Shenyang (CN); Weirong Li, Shenyang (CN); Tiezhuang Tang, Shenyang (CN)

(73) Assignees: INSTITUTE OF METAL RESEARCH, CHINESE ACADEMY OF SCIENCES, Shenyang (CN); DONGGUAN EONTEC CO., LTD., Dongguan (CN)

( * ) Notice: Subject to any disclaimer, the term of this patent is extended or adjusted under 35 U.S.C. 154(b) by 210 days.

(21) Appl. No.: 14/806,678

(22) Filed: Jul. 23, 2015

(65) Prior Publication Data

US 2015/0322555 A1 Nov. 12, 2015

Related U.S. Application Data

(63) Continuation-in-part of application No. PCT/CN2014/075458, filed on Apr. 16, 2014.

(30) Foreign Application Priority Data

Mar. 5, 2014 (CN) ..... 2014 1 0078957

(51) Int. Cl.

| | |
|---|---|
| ***C22C 45/10*** | (2006.01) |
| ***C22F 1/18*** | (2006.01) |
| ***C22C 1/00*** | (2006.01) |
| ***C22C 1/03*** | (2006.01) |

(52) U.S. Cl.

CPC ..... *C22C 45/10* (2013.01); *C22C 1/002* (2013.01); *C22C 1/03* (2013.01); *C22F 1/186* (2013.01)

(58) Field of Classification Search

CPC combination set(s) only.
See application file for complete search history.

(56) References Cited

U.S. PATENT DOCUMENTS

2011/0094633 A1* 4/2011 Gong ..... B22D 27/003 148/403
2011/0308671 A1* 12/2011 Gong ..... C22C 1/002 148/403

FOREIGN PATENT DOCUMENTS

CN 102080196 A * 6/2011 ..... C22C 1/002

OTHER PUBLICATIONS

English Translation of CN 102080196.*

* cited by examiner

*Primary Examiner* — Veronica F Faison
(74) *Attorney, Agent, or Firm* — Matthias Scholl P.C.; Matthias Scholl

(57) ABSTRACT

A bulk amorphous alloy, including, based on atomic percentage amounts, between 41 and 63% of Zr, between 18 and 46% of Cu, between 1.5 and 12.5% of Ni, between 4 and 15% of Al, between 0.01 and 5% of Ag, and between 0.01 and 5% of Y.

1 Claim, 2 Drawing Sheets

BULK AMORPHOUS ALLOY ZR—CU—NI—AL—AG—Y AND METHODS OF PREPARING AND USING THE SAME

CROSS-REFERENCE TO RELATED APPLICATIONS

This application is a continuation-in-part of International Patent Application No. PCT/CN2014/075458 with an international filing date of Apr. 16, 2014, designating the United States, now pending, and further claims priority benefits to Chinese Patent Application No. 201410078957.8 filed Mar. 5, 2014. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND OF THE INVENTION

Field of the Invention

The invention relates to a Zr-based bulk amorphous alloy, and more particularly to a bulk amorphous alloy Zr—Cu—Ni—Al—Ag—Y featuring high amorphous forming ability and antimicrobial properties, as well as methods of preparing and using the same.

Description of the Related Art

Featuring numerous excellent properties, amorphous alloys have been developing quickly in the past few decades and aroused more and more attention. Specifically, Zr-based amorphous alloy exhibits high amorphous forming ability and excellent overall performance, and thus is widely used.

However, conventional Zr-based alloy, for example, Zr—Ti—Cu—Ni—Be alloy, is poisonous; Zr—Ti—Cu—Ni—Al alloy and Zr—Nb—Cu—Ni—Al alloy have low amorphous forming ability. In addition, the amorphous alloys are formed under harsh conditions, thereby increasing the production cost.

SUMMARY OF THE INVENTION

In view of the above-described problems, it is one objective of the invention to provide a bulk amorphous alloy Zr—Cu—Ni—Al—Ag—Y that has high amorphous forming ability, manufacturability and antimicrobial properties, as well as methods of preparing and using the same. Through the introduction of the elements Ag and Y to a quaternary alloy Zr—Cu—Ni—Al and the strong interaction of the element Ag and the element Y, the atomic diffusion during the alloy solidification is impeded, and the precipitation of the crystalline phase is slowed down. As a result, the obtained alloy Zr—Cu—Ni—Al—Ag—Y has high amorphous forming ability, excellent antimicrobial properties, and good manufacturability, and can be repeatedly cast at low degree of vacuum.

To achieve the above objective, in accordance with one embodiment of the invention, there is provided a bulk amorphous alloy, comprising, based on atomic percentage amounts, between 41 and 63% of Zr, between 18 and 46% of Cu, between 1.5 and 12.5% of Ni, between 4 and 15% of Al, between 0.01 and 5% of Ag, and between 0.01 and 5% of Y.

In a class of this embodiment, the alloy comprises, based on atomic percentage amounts, between 49 and 55% of Zr, between 28 and 36% of Cu, between 4 and 10% of Ni, between 2 and 7% of Al, between 0.02 and 1.45% of Ag, and between 0.05 and 3% of Y.

In a class of this embodiment, the alloy has a biggest shape size greater than 20 mm, and the following characteristic thermodynamic parameters: glass transition temperature, between 405 and 420° C.; supercooled liquid region, ΔT=30-70° C.; initial melting temperature, 707-793° C.

In a class of this embodiment, the alloy has a compressed rupture strength of between 1.0 and 1.9 GPa.

In a class of this embodiment, the alloy has good antimicrobial properties and manufacturability, and after four times' casting, the resulting product remains a pure amorphous structure.

The invention also provides a method for preparing a bulk amorphous alloy. The method comprises: 1) employing technical pure Zr, Cu, Ni, Al, Ag and Y as materials; 2) allowing the materials to undergo arc melting or induction melting in the presence of argon to yield a master ingot; and 3) performing copper mold casting on the master ingot to yield the bulk amorphous alloy. The copper mold casting is performed with the following technical parameters: degree of vacuum, between $10^{-1}$ and $10^{-2}$ Pa; temperature, between 980 and 1400° C.; and cooling rate, between 10 and $10^2$ K/s.

Advantages of the bulk amorphous alloy according to embodiments of the invention are summarized as follows.

1. On the basis of a quaternary alloy Zr—Cu—Ni—Al, the invention introduces the metal Ag and the rare earth element Y, whereby obtaining a novel bulk amorphous alloy Zr—Cu—Ni—Al—Ag—Y. Through the strong interaction between the element Ag and the element Y, the atomic diffusion during the alloy solidification is impeded, and the precipitation of the crystalline phase is slowed down. As a result, the obtained alloy Zr—Cu—Ni—Al—Ag—Y has high amorphous forming ability and the largest size of the amorphism is greater than 20 mm. In addition, the amorphous alloy has antimicrobial properties, and the bactericidal rate thereof against *E. Coli* is greater than or equal to 99.9%.

2. Due to the addition of the element Y and the interaction between the metals Y and Ag, the oxygen element of the melt resulting from the alloy melting is floated on the surface of the alloy melt, thereby purifying the alloy melt, so that, after repeated casting in low vacuum (the degree of vacuum is between $10^{-1}$ and $10^{-2}$ Pa), the amorphous alloy still exhibits high amorphous forming ability, which is beneficial to the mass production process and the application of the amorphous alloy.

3. The amorphous alloy Zr—Cu—Ni—Al—Ag—Y has excellent mechanical properties, for example, the compressed rupture strength thereof is 1.9 GPa.

4. The main elements of the amorphous alloy Zr—Cu—Ni—Al—Ag—Y comprising Zr, Cu, and Ni are technical pure materials, thereby reducing the production cost.

5. The Zr-based amorphous alloy can be used for preparing antimicrobial material in the field of consumer electronics, health care, kitchen wares, and transportation.

DETAILED DESCRIPTION OF THE EMBODIMENTS

For further illustrating the invention, experiments detailing a bulk amorphous alloy Zr—Cu—Ni—Al—Ag—Y and methods of preparing and using the same are described below. It should be noted that the following examples are intended to describe and not to limit the invention.

Table 1 lists several bulk amorphous alloy samples as well as the components thereof.

TABLE 1

Bulk amorphous alloy samples and components thereof

| Sample No. | Component (at. %) |
|---|---|
| 1 | $Zr_{50.8}Cu_{35.9}Ag_{0.1}Ni_4Al_9Gd_{0.2}$ |
| 2 | $Zr_{54.53}Cu_{29.75}Ag_{0.3}Ni_{4.97}Al_{9.95}Y_{0.5}$ |
| 3 | $Zr_{52}Cu_{34.9}Ag_{0.1}Ni_5Al_{7.5}Y_{0.5}$ |
| 4 | $Zr_{55.03}Cu_{29.75}Ag_{0.1}Ni_{4.97}Al_{9.95}Y_{0.2}$ |

The bactericidal rate of the bulk amorphous alloy samples is measured using a coating film method (refer to JIS Z 2801-2000), and the concentration of the used *E. coli* ATCC25922 solution is $4.2\times10^5$ cfu/mL.

EXAMPLE 1

The specific Zr-based amorphous alloy is $Zr_{54.53}Cu_{29.75}Ag_{0.3}Ni_{4.97}Al_{9.95}Y_{0.5}$ (at. %) (sample No. 2 in Table 1).

Technical pure metals Zr, Cu, Ni, Al, Ag, Y were selected as materials, and the element Zr employed zirconium sponge. The materials were mixed according to atomic percentage amounts, and allowed to undergo arc melting in the presence of argon, to yield a master ingot. To ensure the uniformity, the alloy ingot was melted reversely for at least four times. The master ingot was remelt and blown into a copper mold with a diameter of 20 mm using vacuum casting equipment. The operation temperature was 1000° C., and the degree of vacuum was $10^{-1}$ Pa.

Figure 1:
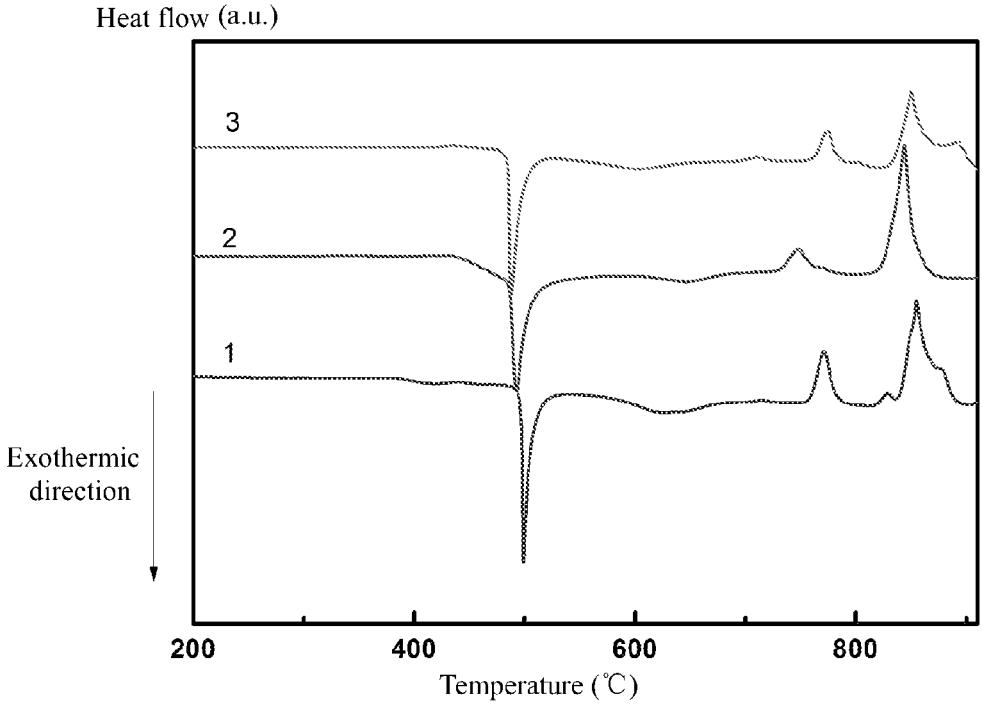
FIG. 1 is a differential scanning calorimeter (DSC) curve of an amorphous alloy in accordance with one embodiment of the invention.
Figure 2:
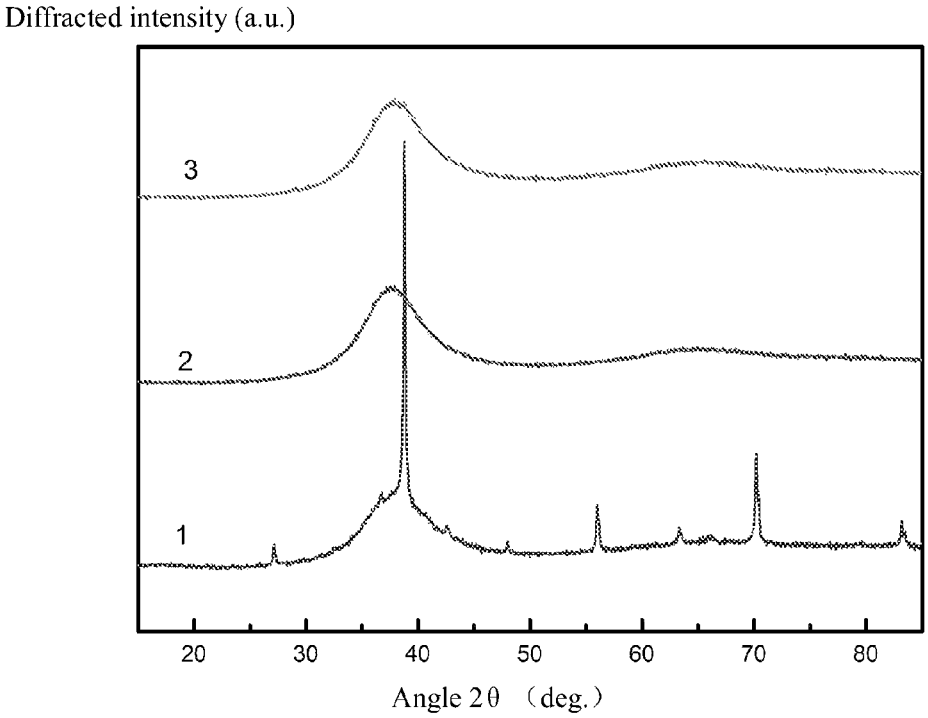
FIG. 2 is an XRD pattern of an amorphous alloy in accordance with one embodiment of the invention.
Figure 3:
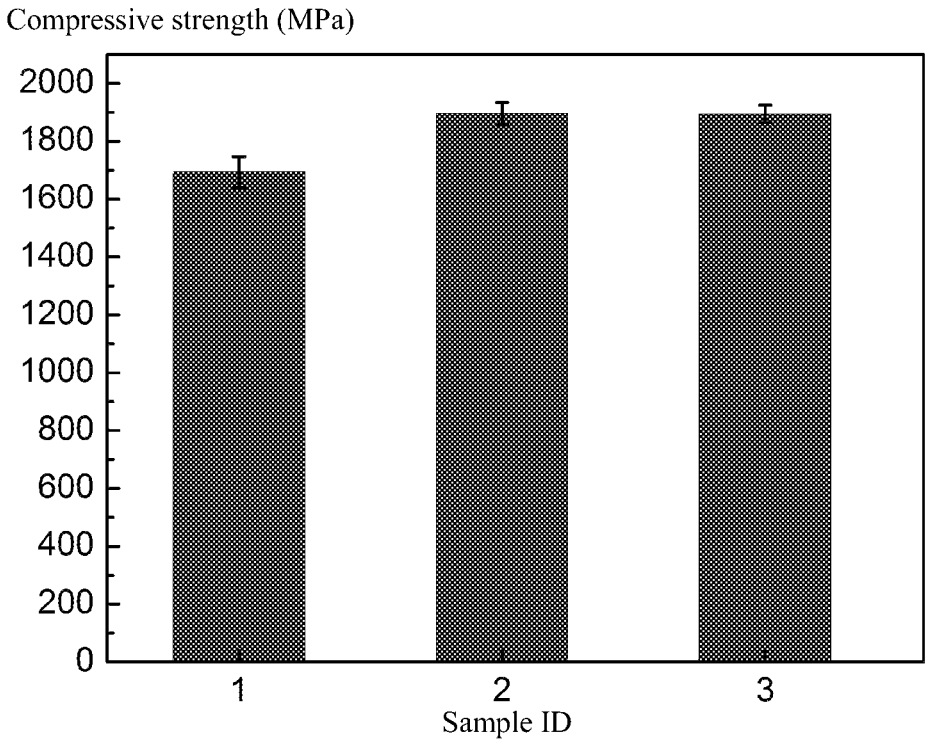
FIG. 3 is a compression curve of an amorphous alloy in accordance with one embodiment of the invention.

X-ray diffraction showed that, the alloy was a single pure amorphous structure, as shown in FIG. 2. As shown in FIGS. 1 and 3, the glass transition temperature Tg of the alloy was 420° C.; the supercooled liquid region ΔT thereof was 60° C.; the initial melting temperature Tm thereof was 730° C.; and the compressed rupture strength thereof was 1.89 GPa.

The bactericidal rate of the bulk amorphous alloy against *E. Coli* was greater than or equal to 99.9%.

Figure 4:
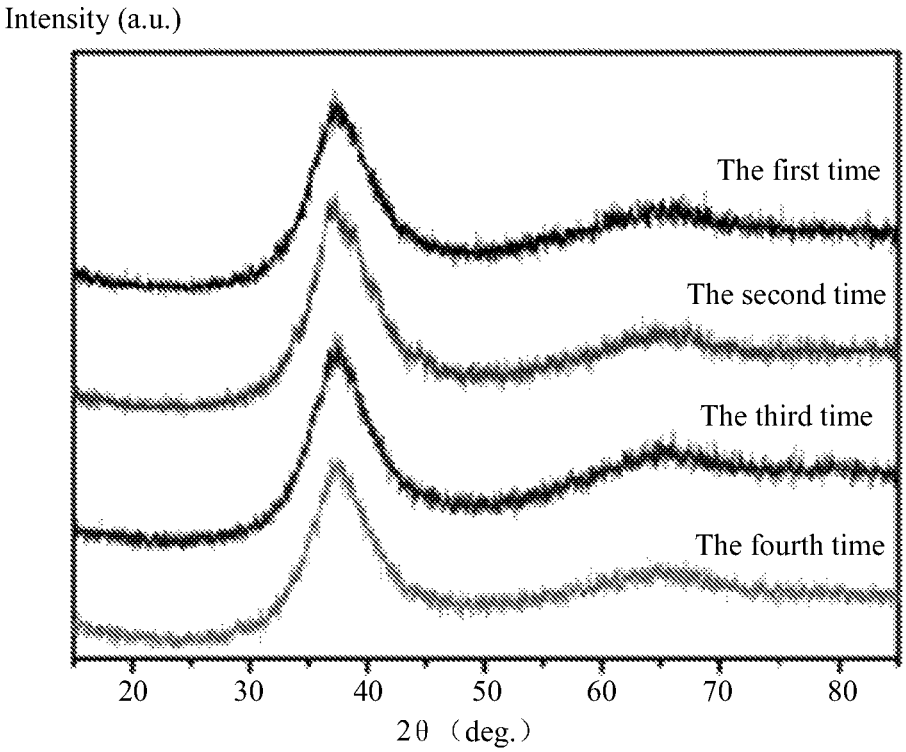
FIG. 4 is an XRD pattern of an amorphous alloy in FIG. 1 after being recast.

As shown in FIG. 4, after four times' repeated casting, the resulting products remained a single pure amorphous structure.

EXAMPLE 2

Different from Example 1, the specific Zr-based amorphous alloy is $Zr_{52}Cu_{34.9}Ag_{0.1}Ni_5Al_{7.5}Y_{0.5}$ (at. %) (sample No. 3 in Table 1).

X-ray diffraction showed that, the alloy was a single pure amorphous structure, as shown in FIG. 2. As shown in FIGS. 1 and 3, the glass transition temperature Tg of the alloy was 414° C.; the supercooled liquid region ΔT thereof was 65° C.; the initial melting temperature Tm thereof was 757° C.; and the compressed rupture strength thereof was 1.9 GPa. Other properties were the same as that in Example 1.

EXAMPLE 3

Different from Example 1, the specific Zr-based amorphous alloy is $Zr_{55.03}Cu_{29.75}Ag_{0.1}Ni_{4.97}Al_{9.95}Y_{0.2}$ (at. %) (sample No. 4 in Table 1).

X-ray diffraction showed that, the alloy was a single pure amorphous structure. The glass transition temperature Tg of the alloy was 420° C.; the supercooled liquid region ΔT thereof was 60° C.; the initial melting temperature Tm thereof was 730° C.; and the compressed rupture strength thereof was 1.9 GPa. Other properties were the same as that in Example 1.

COMPARISON EXAMPLE 1

Different from Example 1, the specific Zr-based amorphous alloy is $Zr_{50.8}Cu_{35.9}Ag_{0.1}Ni_4Al_9Gd_{0.2}$ (at. %) (sample No. 1 in Table 1).

X-ray diffraction showed that, the alloy was a single pure amorphous structure, as shown in FIG. 2. As shown in FIGS. 1 and 3, the glass transition temperature Tg of the alloy was 420° C.; the supercooled liquid region ΔT thereof was 70° C.; the initial melting temperature Tm thereof was 755° C.; and the compressed rupture strength thereof was 1.68 GPa.

COMPARISON EXAMPLE 2

Different from Example 1, the specific Zr-based amorphous alloy is $Zr_{51}Cu_{30}Ag_3Ni_5Al_{11}$.

When the alloy underwent the second casting at low vacuum, crystalline phase precipitated from the cast sample.

COMPARISON EXAMPLE 3

Different from Example 1, the specific Zr-based amorphous alloy is $Zr_{52}Cu_{35}Ni_5Al_{7.5}Y_{0.5}$.

The amorphous forming ability of the alloy was less than 9 mm and no bactericidal effect detected.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for preparing an antimicrobial material, the method comprising admixing a bulk amorphous alloy to a material not having antimicrobial properties to yield the antimicrobial material, wherein the bulk amorphous alloy comprises, based on atomic percentage amounts, between 41 and 63% of Zr, between 18 and 46% of Cu, between 1.5 and 12.5% of Ni, between 4 and 15% of Al, between 0.01 and 5% of Ag, and between 0.01 and 5% of Y.

* * * * *